US008186780B2

(12) United States Patent
Liang et al.

(10) Patent No.: US 8,186,780 B2
(45) Date of Patent: May 29, 2012

(54) ADJUSTMENT DEVICE FOR SLIDE ASSEMBLY

(75) Inventors: Hsiu-Chiang Liang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 372 days.

(21) Appl. No.: 12/626,751

(22) Filed: Nov. 27, 2009

(65) Prior Publication Data

US 2011/0129171 A1 Jun. 2, 2011

(51) Int. Cl.
*A47B 88/00* (2006.01)

(52) U.S. Cl. ..... 312/334.5; 312/334.6

(58) Field of Classification Search ..... 312/333, 312/319.1, 334.4, 334.5, 334.14, 330.1, 334.6; 384/21, 22

See application file for complete search history.

(56) References Cited

U.S. PATENT DOCUMENTS

| | | | | | |
|---|---|---|---|---|---|
| 858,420 | A | * | 7/1907 | Schneider | 384/22 |
| 2,698,214 | A | * | 12/1954 | Skamser | 312/334.5 |
| 2,928,696 | A | * | 3/1960 | Hiers | 384/19 |
| 3,850,482 | A | * | 11/1974 | Gutner | 384/22 |
| 4,500,140 | A | * | 2/1985 | Lautenschlager et al. | 384/19 |
| 4,842,422 | A | * | 6/1989 | Nelson | 384/19 |
| 4,983,000 | A | * | 1/1991 | Rock | 312/333 |
| 5,364,179 | A | * | 11/1994 | Brustle et al. | 312/333 |
| 5,375,922 | A | * | 12/1994 | Brustle et al. | 312/334.4 |
| 5,474,375 | A | * | 12/1995 | Hollenstein et al. | 312/319.1 |
| 6,848,761 | B2 | * | 2/2005 | Salice | 312/334.4 |
| 6,945,618 | B2 | * | 9/2005 | Kim et al. | 312/334.4 |
| 7,549,712 | B2 | * | 6/2009 | Booker et al. | 312/334.6 |
| 2002/0190618 | A1 | * | 12/2002 | Salice | 312/334.4 |
| 2003/0205955 | A1 | * | 11/2003 | Egger | 312/334.5 |
| 2004/0145286 | A1 | * | 7/2004 | Kim | 312/334.4 |
| 2007/0046158 | A1 | * | 3/2007 | Hoffman | 312/333 |
| 2009/0261700 | A1 | * | 10/2009 | Chen et al. | 312/334.46 |
| 2011/0012488 | A1 | * | 1/2011 | Liang et al. | 312/319.1 |
| 2011/0042446 | A1 | * | 2/2011 | Liang et al. | 228/196 |

FOREIGN PATENT DOCUMENTS

JP 2004160224 * 6/2004

* cited by examiner

*Primary Examiner* — Janet M Wilkens
(74) *Attorney, Agent, or Firm* — Rosenberg, Klein & Lee

(57) ABSTRACT

A slide assembly with an adjustment device includes a first slide member, a second slide member, a guiding member, an adjusting base and a pivot member. The first slide member has a first panel and a second panel. The second slide member is movable relative to the first slide member in a longitudinal direction. The guiding member is mounted on the first panel and includes an accommodation room. The accommodation room has a lateral hole. The adjusting base includes a board, a protruding member, a hole defined through the board and eccentrically through the protruding member, and an adjusting portion. One portion of the board is contact with the second panel of the first slide member. The protruding member leans against an inner wall of the accommodation room. By adjusting the adjusting base, the guiding member can be moved by the protruding member relative to the second slide member.

8 Claims, 7 Drawing Sheets

ADJUSTMENT DEVICE FOR SLIDE ASSEMBLY

FIELD OF THE INVENTION

The present invention relates to an adjustment device for a slide assembly, and more particularly, to a guiding member connected to a first slide member of the slide assembly. The guiding member is able to be micro-adjusted relative to the other slide member of the slide assembly.

BACKGROUND OF THE INVENTION

A conventional slide assembly generally includes a first rail and a second rail which is longitudinally and slidably connected to the first rail. An assistance shifting device, such as the "Closing device for drawers" disclosed in U.S. Pat. No. 5,364,179, is connected to the slide assembly. The closing device includes a support rail having a horizontal web, a pull-out rail longitudinally and slidably connected to the support rail and including a pin member, a guide housing connected to the horizontal web of the support rail and including a guide groove, a tiltable member connected to the guide groove of the guide housing and having an upwardly open slot, and a spring connected to the tiltable member. When the pull-out rail is retracted relative to the support rail, the pin member of the pull-out rail is engaged with the upwardly open slot of the tiltable member so that the tiltable member can be moved within the guide groove by the pull-out rail. The spring applies a force to the tiltable member and the spring force together with the pulling force of the liftable member to automatically retract relative to the support rail.

When the slide assembly is used to a drawer, the drawer has two pull-out rails on two sides thereof and the two insides of the cabinet to which the drawer is connected have two support rails to which the pull-out rails are connected. The drawer can be pulled out from or retracted into the cabinet by the slide assembly. When the drawer is moved to a pre-set distance in the cabinet, the closing device is used to assist the drawer to be automatically retracted into the cabinet by the contact between the pin member of the pull-out rails and the upwardly open slots in the tiltable members.

Actually, when the pull-out rails are moved longitudinally relative to the support rails, a gap exists in a lateral direction. However, when the slide assembly is connected to a piece of furniture such as a drawer to a cabinet, the lateral gap slightly changes due to installation and tolerance of the parts of the furniture. The change of the lateral gap affects the contact between the pin member of the pull-out rails and the upwardly open slots in the tiltable members, thereby affecting the feature of automatic retraction of the drawer.

Accordingly, it is necessary to provide an adjustment device for adjusting the change of the lateral gap so as to improve the shortcomings of the conventional slide assembly.

SUMMARY OF THE INVENTION

The primary object of the present invention is to provide an adjustment device for a slide assembly. The slide assembly includes a guiding member which is micro-adjusted relative to the slide assembly so as to adjust the movement of the slide assembly.

The present invention relates to a slide assembly and comprises a first slide member which has a first panel and a second panel extending perpendicularly from the first panel. A second slide member is longitudinally movable relative to the first slide member. A guiding member has a first end and a second end longitudinally opposite to the first end. The first end is connected to the first panel of the first slide member. The second end includes a first wall, a second wall and a bottom wall which is connected between the first and second walls. An accommodation room is defined among the first wall, the second wall and the bottom wall. A lateral hole is defined through the bottom wall. A passage is defined between the first and second ends. An adjusting base includes a board, a protruding member extending from an underside of the board and a hole defined through the board and eccentrically through the protruding member. The board has a portion leaning against the second panel of the first slide member and the protruding member is located within the accommodation room. A pivot member extends through the hole of the adjusting base and the lateral hole of the guiding member and is connected to the first panel of the first slide member. When the adjusting base is turned, the protruding member pushes the first wall or the second wall in the accommodation room to laterally adjust the second end of the guiding member.

Preferably, the board of the adjusting base includes a curved contact side which faces the second panel and has a plurality of protrusions.

Preferably, the first end of the guiding member includes a fixing portion and the first panel of the first slide member has an anchoring member which anchors the fixing portion.

Alternatively, the first end of the guiding member has a fixing portion which is pivotably connected to the first panel of the first slide member by a pin.

Preferably, the adjusting base includes an adjusting portion disposed on top of the board and located beside the hole. When a hand tool such as a screwdriver is inserted into the adjusting portion and rotated, the adjusting base is adjusted and shifted.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
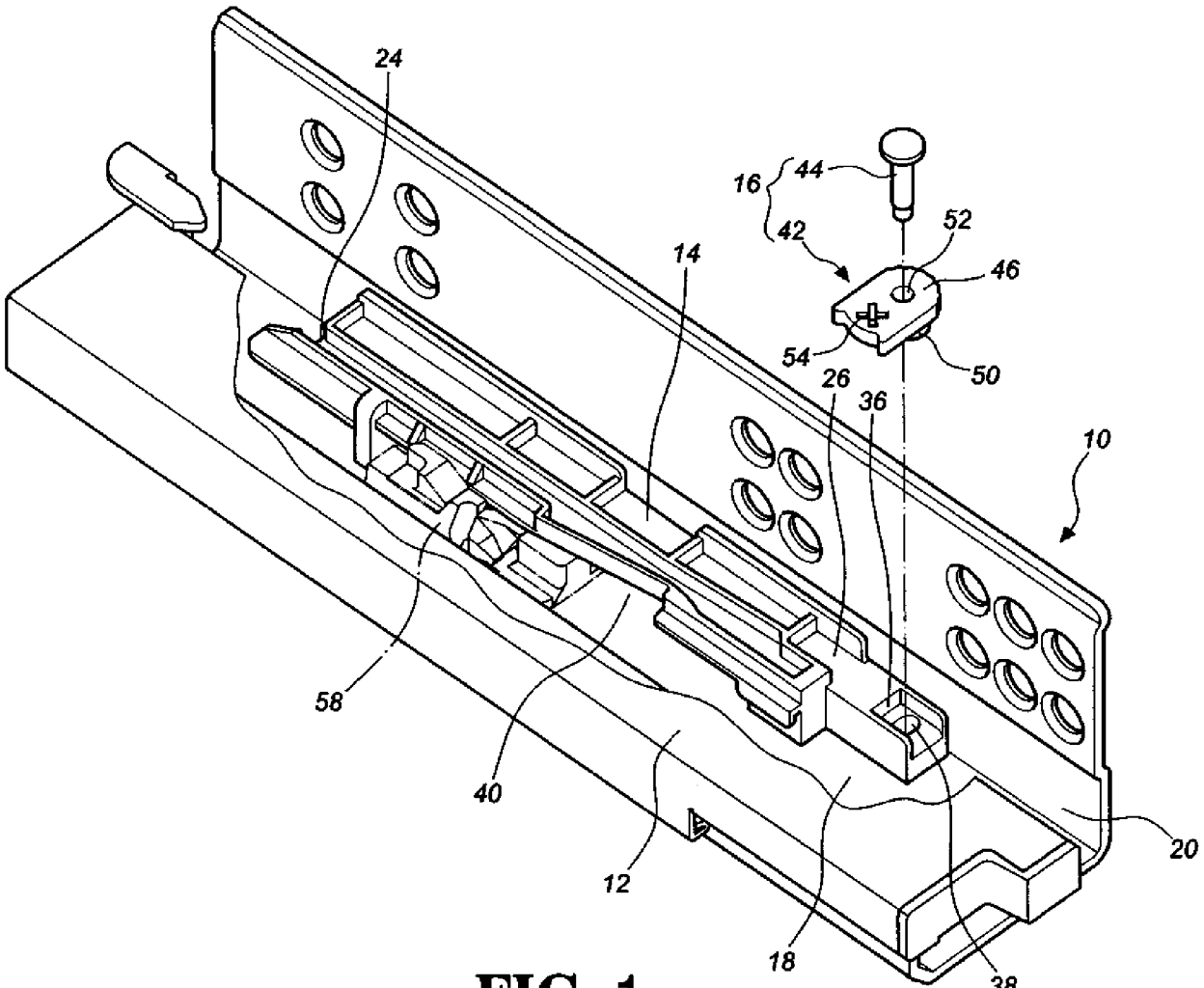
FIG. 1 is an exploded view showing the slide assembly according to a first embodiment of the present invention.

As shown in FIG. 1, the slide assembly according to a first embodiment of the present invention comprises a first slide member 10, a second slide member 12 which is longitudinally movable relative to the first slide member 10, a guiding member 14 connected to the first slide member 10, and an adjustment device 16 which adjusts the lateral position of the guiding member 14 relative to the first slide member 10.

Figure 2:
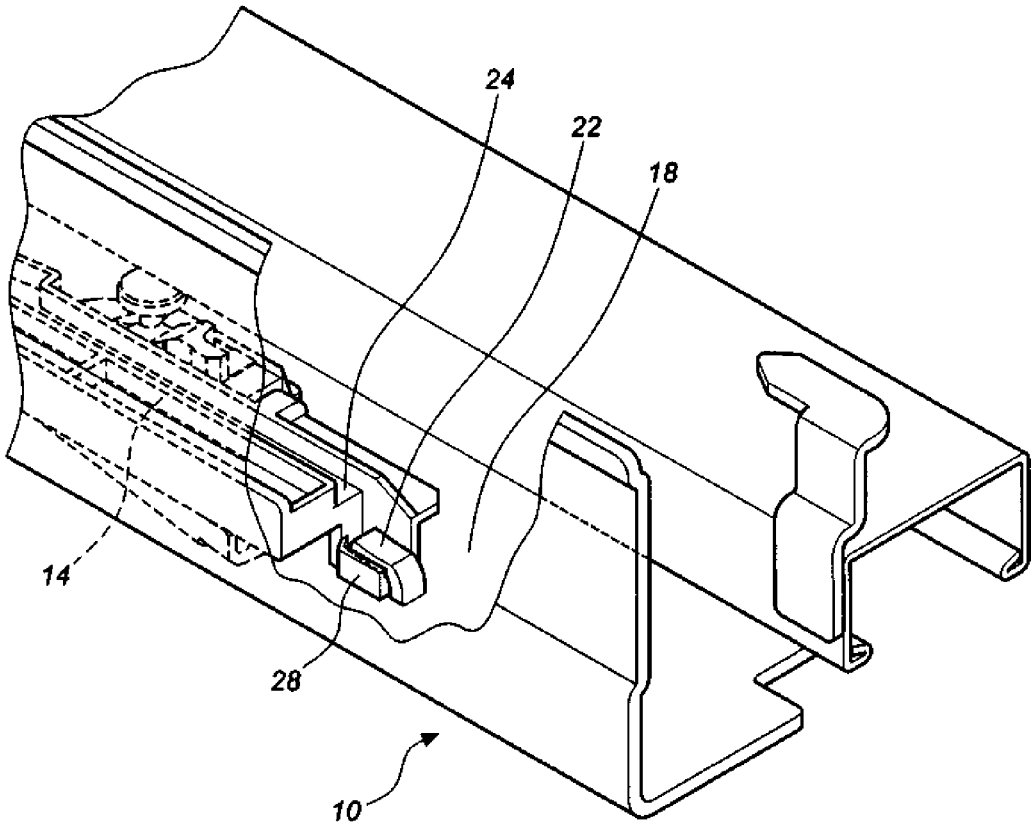
FIG. 2 is a schematic view showing that the guiding member has one end connected to the first slide member of the slide assembly according to the first embodiment of the present invention.

The first slide member 10 has a first panel 18 and a second panel 20 which is perpendicularly connected to the first panel 18. Preferably, the second panel 20 perpendicularly extends from the first panel 18. Referring to FIG. 2, the first panel 18 includes an anchoring member 22 thereon.

Figure 3:
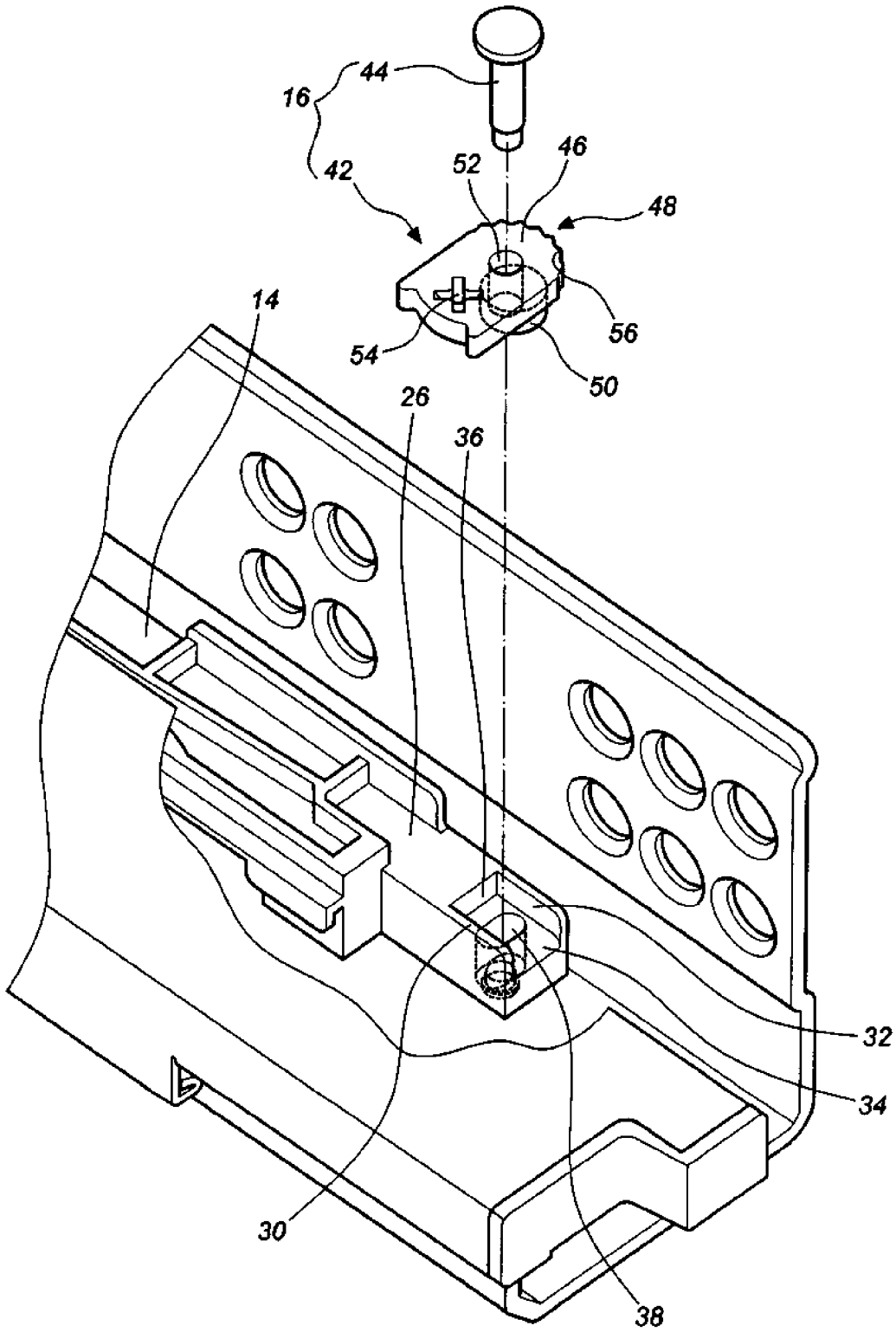
FIG. 3 is an enlarged view showing the adjustment device and the guiding member of the slide assembly according to the first embodiment of the present invention.

The guiding member 14 is used to guide the second slide member 12 to move relative to the first slide member 10, and includes a first end 24 and a second end 26 which is longitudinally opposite to the first end 24. As shown in FIG. 2, the first end 24 of the guiding member 14 has a fixing portion 28 which is connected to the anchoring member 22 of the first panel 18 of the first slide member 10. As shown in FIG. 3, the second end 26 of the guiding member 14 includes a first wall 30, a second wall 32 and a bottom wall 34 which is connected between the first and second walls 30, 32. An accommodation room 36 is defined among the first wall 30, the second wall 32 and the bottom wall 34. The inside of the accommodation room 36 includes the first wall 30 or the second wall 32. A lateral hole 38 is defined through the bottom wall 34. A passage 40 is defined between the first and second ends 24, 26.

Figure 4:
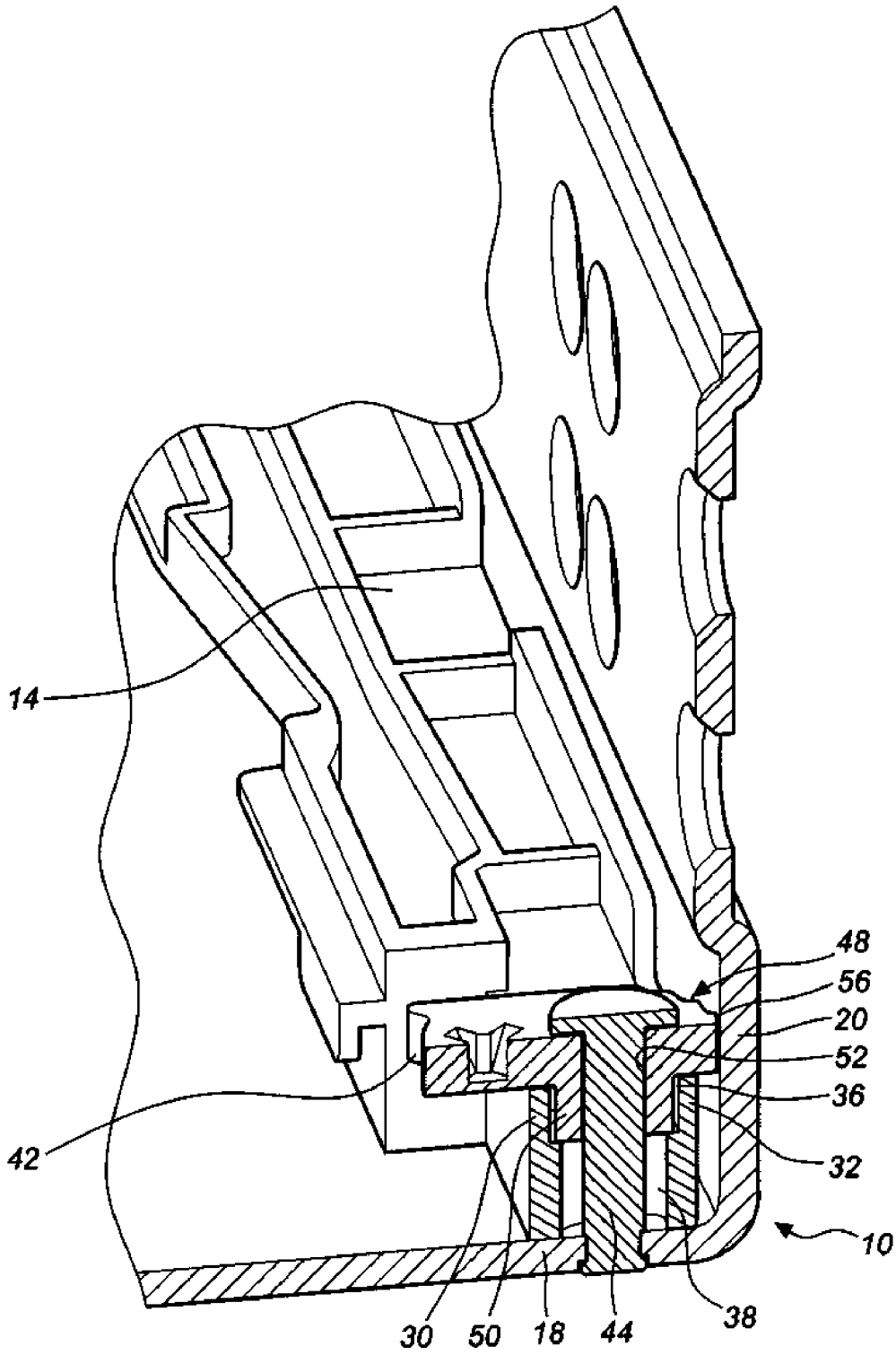
FIG. 4 is a cross-sectional view showing the adjustment device installed on the first slide member according to the first embodiment of the present invention.

Further referring to FIG. 3, the adjustment device 16 includes an adjusting base 42 and a pivot member 44. The adjusting base 42 includes a board 46 which has a curved contact side 48 facing the second panel 20 and has a plurality of protrusions 56. A protruding member 50 extends from an underside of the board 46 and a hole 52 is defined through the board 46 and eccentrically through the protruding member 50. An adjusting portion 54 is disposed on top of the board 46 and located beside the hole 52. Referring to FIG. 4, the pivot member 44 extends through the hole 52 of the adjusting base 42 and the lateral hole 38 of the guiding member 14 and is connected to the first panel 18 of the first slide member 10. A portion of the protrusions 56 is contact with the second panel 20 of the first slide member 10, and the protruding member 50 is located within the accommodation room 36 of the guiding member 14.

Figure 5:
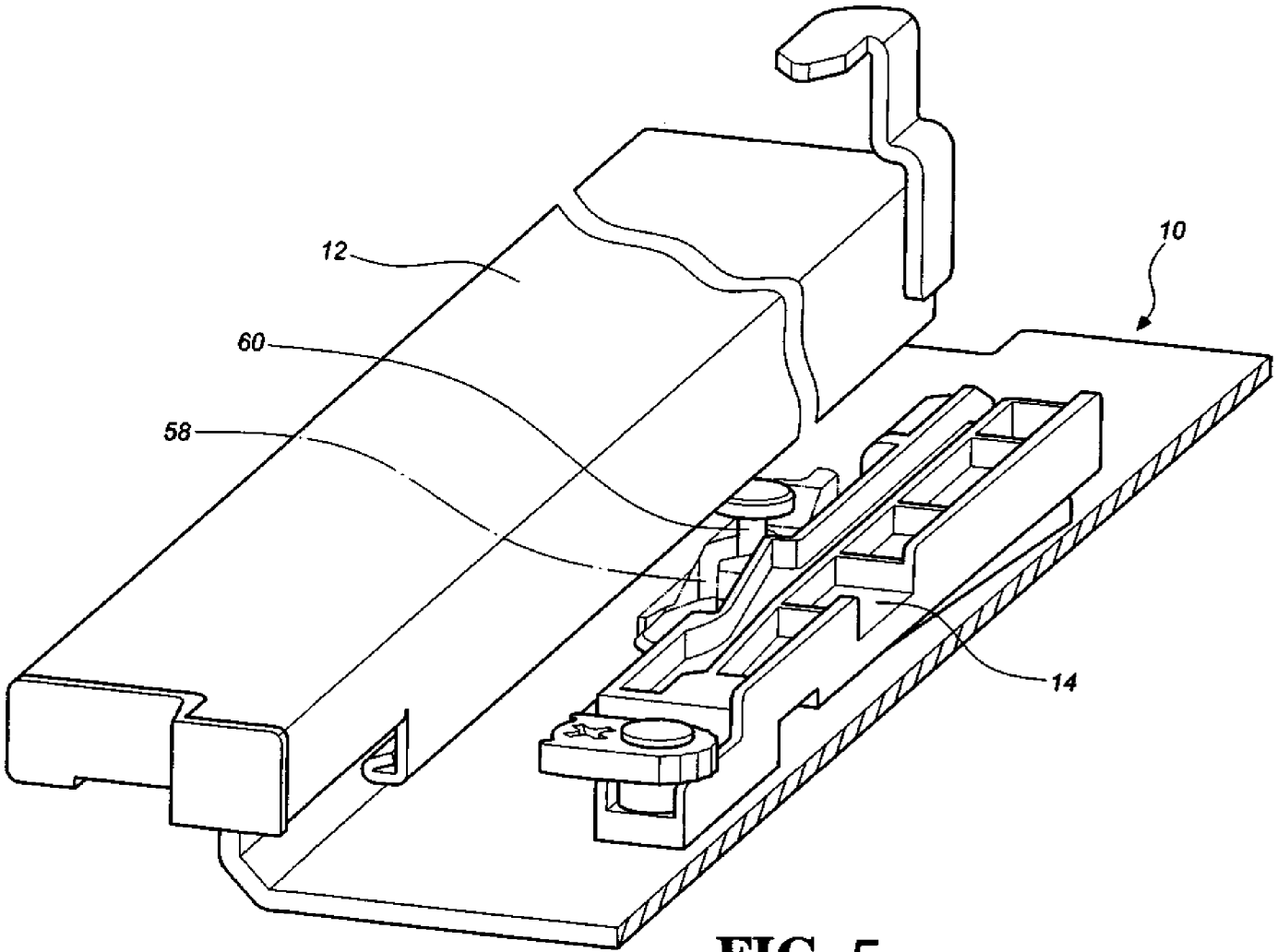
FIG. 5 is a schematic view showing the assistance shifting device disposed on the slide assembly according to the first embodiment of the present invention.

As shown in FIGS. 1 and 5, an assistance shifting device 58 is connected to the passage 40 of the guiding member 14. The assistance shifting device 58 can be a self-closing device, a self-opening device, or a self-closing and self-opening device. However, the assistance shifting device 58 is known to persons in the art and will not be described in detail. The second slide member 12 includes a connection member 60 which is connected to or separated from the assistance shifting device 58. The connection member 60 and the assistance shifting device 58 have a relative track relationship in a longitudinal direction when the second slide member 12 is longitudinally moved relative to the first slide member 10.

When the position of the connection member 60 of the second slide member 12 relative to the passage 40 of the guiding member 14 is deflected, the position of the guiding member 14 relative to the second slide member 12 must be adjusted for engagement or disengagement of the connection member 60 and the assistance shifting device 58 in the longitudinal direction.

Figure 6:
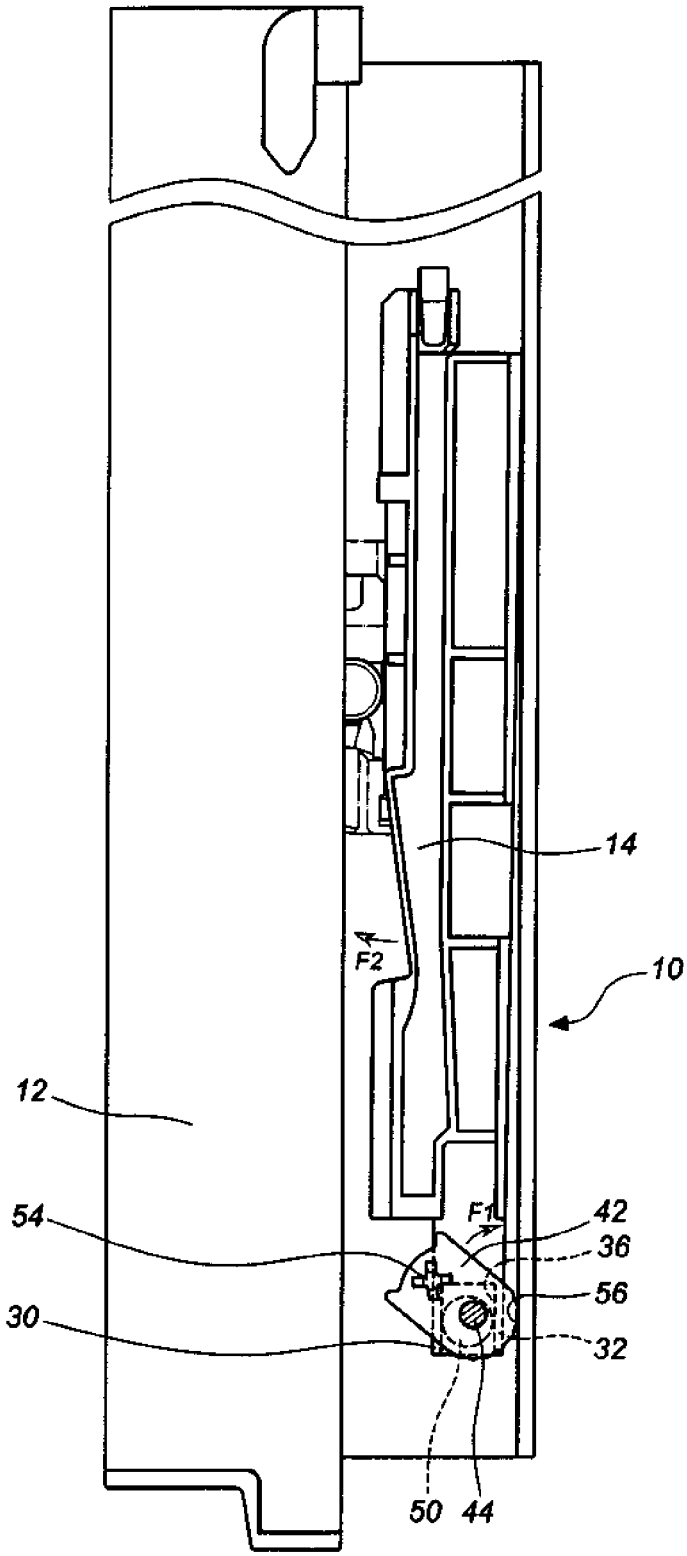
FIG. 6 is a schematic view showing that the adjusting base is turned to adjust the first slide member.

Referring to FIG. 6, when adjusting, if the adjusting portion 54 of the adjusting base 42 is a cross slot, then a screwdriver with a Phillips head tip can be inserted into the adjusting portion 54 and rotates the adjusting base 42 about the pivot member 44 in the direction shown by the arrow head F1, the protruding member 50 is rotated in the accommodation room 36 to push the first wall 30 or the second wall 32 in the accommodation room 36. By doing this, the guiding member 14 is laterally adjusted relative to the second slide member 12. The arrow head F2 in FIG. 6 shows that the guiding member 14 is pushed by the adjusting base 42 and moved relative to the second slide member 12. The protrusions 56 leans against the second panel 20 of the first slide member 10 so as to position the adjusting base 42.

It is noted that the adjusting portion 54 of the adjusting base 42 can be other shape of slot so as to be cooperated with different tools.

Figure 7:
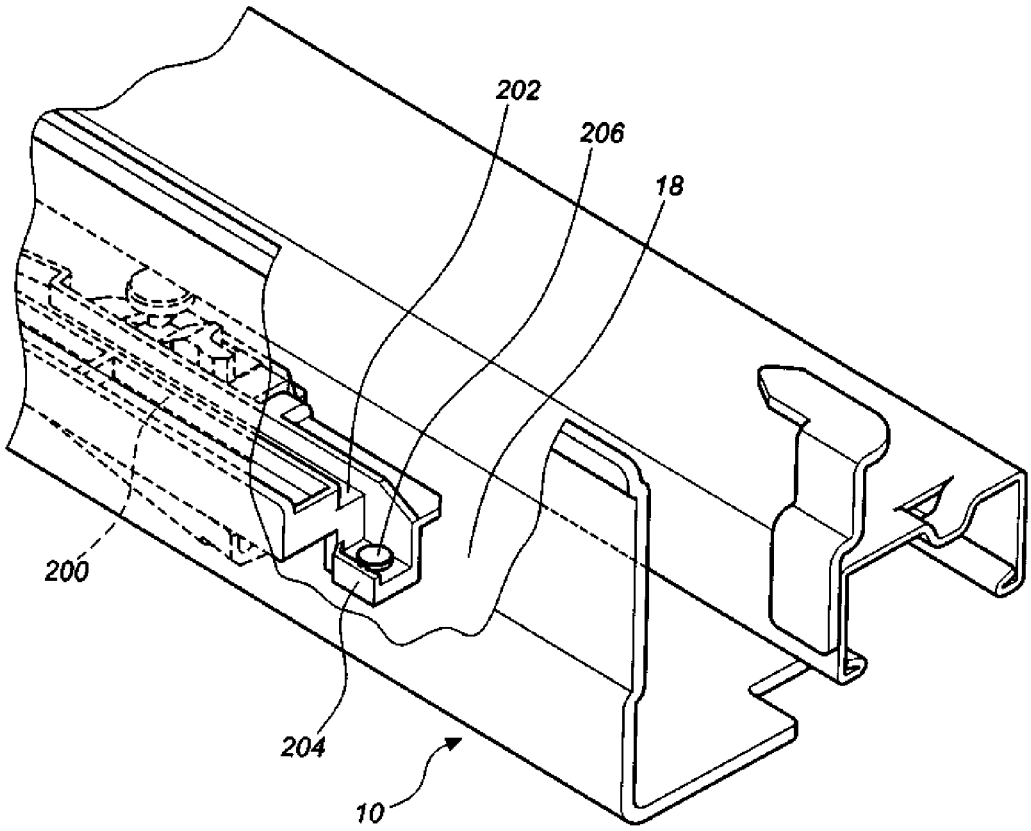
FIG. 7 is a schematic view showing the connection between the guiding member and the first slide member according to a second embodiment of the present invention.

As shown in FIGS. 1 and 2, if the guiding member 14 is made of flexible material, the first end 24 of the guiding member 14 can be fixed to the first panel 18 of the first slide member 10. The second end 26 of the guiding member 14 can be micro-adjusted by the adjustment device 16. Alternatively, as shown in FIG. 7, the first end 202 of the guiding member 200 has a fixing portion 204 which is pivotably connected to the first panel 18 of the first slide member 10 by a pin 206, regardless of the nature of the material of the guiding member 200. By this way, the guiding member 200 is adjusted by the adjustment device 16.

While we have shown and described the embodiment in accordance with the present invention, it should be clear to those skilled in the art that further embodiments may be made without departing from the scope of the present invention.

What is claimed is:

1. A slide assembly, comprising:

a first slide member having a first panel and a second panel which perpendicularly extends from the first panel;

a second slide member longitudinally movable relative to the first slide member;

a guiding member having a first end and a second end longitudinally opposite to the first end, the first end connected to the first panel of the first slide member, the second end including a first wall, a second wall and a bottom wall connected between the first and second walls, an accommodation room defined among the first wall, the second wall and the bottom wall, a lateral hole defined through the bottom wall, a passage defined between the first and second ends;

an adjusting base having a board, a protruding member extending from an underside of the board and a hole defined through the board and eccentrically through the protruding member, the board having a portion leaning against the second panel of the first slide member, the protruding member being located within the accommodation room; and a pivot member extending through the hole of the adjusting base and the lateral hole of the guiding member to be connected to the first panel of the first slide member.

2. The slide assembly as claimed in claim 1, wherein the adjusting base includes an adjusting portion disposed on top of the board and located beside the hole.

3. The slide assembly as claimed in claim 1, wherein the board of the adjusting base includes a curved contact side which faces the second panel and has a plurality of protrusions.

4. The slide assembly as claimed in claim 1, wherein the first end of the guiding member includes a fixing portion and the first panel of the first slide member has an anchoring member which anchors the fixing portion.

5. The slide assembly as claimed in claim 1, wherein the first end of the guiding member has a fixing portion which is pivotably connected to the first panel of the first slide member by a pin.

6. An adjustment device of a slide assembly, the slide assembly comprising a first slide member and a second slide member, the first slide member having a first panel and a second panel, the second slide member being longitudinally movable relative to the first slide member; the adjustment device comprising:

a guiding member having a first end and a second end longitudinally opposite to the first end, the first end being connected to the first panel of the first slide member, the second end including an accommodation room which has a bottom wall, a lateral hole defined through the bottom wall;

an adjusting base having a board which includes a curved contact side facing the second panel, a protruding member extending from an underside of the board and a hole defined through the board and eccentrically through the protruding member; and a pivot member extending through the hole of the adjusting base and the lateral hole of the guiding member to be connected to the first slide member;

wherein when the adjusting base is adjusted, the adjusting base is pivoted about the pivot member and the protruding member of the adjusting base is turned in the accommodation room and pushes a wall of the accommodation room to shift the second end of the guiding member laterally.

7. The adjustment device as claimed in claim 6, wherein the adjusting base includes an adjusting portion disposed on top of the board and located beside the hole.

8. The adjustment device as claimed in claim 6, wherein the curved contact side of the board has a plurality of protrusions.

* * * * *